US011790745B2

(12) United States Patent
Athelly et al.

(10) Patent No.: US 11,790,745 B2
(45) Date of Patent: Oct. 17, 2023

(54) FIRE DETECTION WITH DATA TRANSMISSION

(71) Applicant: CARRIER CORPORATION, Palm Beach Gardens, FL (US)

(72) Inventors: Rajesh Athelly, Telanganda (IN); Srikanth Govindavaram, Andhra Pradesh (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 123 days.

(21) Appl. No.: 15/734,306

(22) PCT Filed: Dec. 5, 2019

(86) PCT No.: PCT/US2019/064585
§ 371 (c)(1),
(2) Date: Dec. 2, 2020

(87) PCT Pub. No.: WO2020/118001
PCT Pub. Date: Jun. 11, 2020

(65) Prior Publication Data

US 2021/0287510 A1 Sep. 16, 2021

(30) Foreign Application Priority Data

Dec. 5, 2018 (IN) ..... 201811045919

(51) Int. Cl.
*G08B 17/103* (2006.01)

(52) U.S. Cl.
CPC ..... *G08B 17/103* (2013.01)

(58) Field of Classification Search
CPC ..... G08B 17/103
See application file for complete search history.

(56) References Cited

U.S. PATENT DOCUMENTS 7,101,143 B2 * 9/2006 Orthaus ..... E01F 9/70 414/788.2
7,431,532 B2 * 10/2008 Lidster ..... E01F 9/70 414/539

(Continued)

FOREIGN PATENT DOCUMENTS

CN 105632088 A 6/2016
CN 205508049 U 8/2016

(Continued)

OTHER PUBLICATIONS

International Preliminary Report on Patentability; dated Jun. 8, 2021; Application No. PCT/US2019/064585; Filed: Dec. 5, 2019; 7 pages.

(Continued)

*Primary Examiner* — Hoi C Lau
(74) *Attorney, Agent, or Firm* — CANTOR COLBURN LLP

(57) ABSTRACT

Systems and methods for smoke detection are provided. Aspects include operating a first device to transmit a first alphanumeric code to a second device by transmitting a modulated optical signal to the second device, wherein the modulated optical signal represents the first alphanumeric code, wherein the first device comprises an optical signal source configured to transmit a modulated optical signal through a medium, and wherein the second device is configured to receive the modulated optical signal through the medium. Analyzing the modulated optical signal received at the second device to convert the modulated optical signal to a second alphanumeric code and comparing the first alphanumeric code to the second alphanumeric code to determine a presence of one or more conditions between the first device and second device.

19 Claims, 3 Drawing Sheets

(56) References Cited

U.S. PATENT DOCUMENTS

| | | | | |
|---|---|---|---|---|
| 7,493,049 | B1 * | 2/2009 | Conemac | G02B 6/3817 381/172 |
| 9,781,813 | B2 | 10/2017 | Johnson | |
| 9,924,579 | B2 | 3/2018 | Tran | |
| 9,979,476 | B2 | 5/2018 | Breuer et al. | |
| 9,986,313 | B2 | 5/2018 | Schwarzkopf et al. | |
| 11,151,853 | B2 * | 10/2021 | Birnkrant | G08B 17/107 |
| 2002/0080040 | A1 | 6/2002 | Schneider et al. | |
| 2004/0057822 | A1 * | 3/2004 | Orthaus | E01F 9/70 414/539 |
| 2013/0156532 | A1 * | 6/2013 | Hemphill | B60P 1/02 414/495 |
| 2016/0343226 | A1 * | 11/2016 | Fischer | G08B 17/107 |
| 2017/0344028 | A1 | 11/2017 | Westermo et al. | |
| 2020/0382214 | A1 * | 12/2020 | Ori | G02B 6/29361 |

FOREIGN PATENT DOCUMENTS

| | | | | |
|---|---|---|---|---|
| JP | 2008096176 | A | 4/2008 | |
| WO | 2017093839 | A1 | 6/2017 | |
| WO | 2018010915 | A1 | 1/2018 | |
| WO | 2018089660 | A1 | 5/2018 | |
| WO | WO-2018089660 | A1 * | 5/2018 | G08B 13/124 |

OTHER PUBLICATIONS

Deepika et al., "Applicability of LIFI Technology for Industrial Automation System", International Research Journal of Engineering and Technology (IRJET), vol. 5, Issue 2, Feb. 2018, pp. 259-262.

Kesavan et al., "Ship to Ship Communication System Using Li-Fi Technology", International Journal of Research in Electrical Engineering (IJREE), vol. 5, Issue 1, 2018, pp. 21-22.

Khalifa et al., "Wireless Smoke Detection System", IEEE, Proceedings of the International Conference on Computer and Communication Engineering, May 13-15, 2008, pp. 409-413.

Nelson, "DarkLigh removes Li-Fi restriction, allows visible light to transmit data in the dark", NetworkWorld, Oct. 17, 2016, 5 pages.

International Search Report and Written Opinion; dated Feb. 21, 2020; Application No. PCT/US2019/064585; Filed: Dec. 5, 2019; 14 pages.

* cited by examiner

FIRE DETECTION WITH DATA TRANSMISSION

CROSS REFERENCE TO RELATED APPLICATIONS

This application is a National Stage application of PCT/US2019/064585, filed Dec. 5, 2019, which claims the benefit of Indian Provisional Application No.: 201811045919, filed Dec. 5, 2018, both of which are incorporated by reference in their entirety herein.

BACKGROUND

Exemplary embodiments pertain to the art of fire detection systems and more specifically to fire detection system utilizing light fidelity (Li-Fi) transmission signals.

Conventional smoke detection systems operate by detecting the presence of smoke or other airborne pollutants. Upon detection of a threshold level of particles, an alarm or other signal, such as a notification signal, may be activated and operation of a fire suppression system may be initiated. Photoelectric smoke detection systems use light scattering to determine the presence of particles in the ambient atmosphere to indicate existence of smoke between a light source and a light sensitive receiver. However, these photoelectric smoke detections systems can take between 30 to 60 seconds to detect a fire as these systems rely on the reflection of light from smoke particles to reach a light sensitive receiver.

High sensitivity smoke detection systems may incorporate a pipe network consisting of one or more pipes with holes or inlets installed at positions where smoke or pre-fire emissions may be collected from a region or environment being monitored. Air is drawn into the pipe network through the inlets, such as via a fan, and is subsequently directed to a detector. In some conventional smoke detection systems, individual sensor units may be positioned at each sensing location, and each sensor unit has its own processing and sensing components.

Delays in the detecting the presence of the fire may occur in conventional point smoke detectors and also pipe network detection systems, for example due to the smoke transport time. In pipe network detection systems, due to the size of the pipe network, there is a typically a time delay between when the smoke enters the pipe network through an inlet and when that smoke actually reaches the remote detector. In addition, because smoke or other pollutants initially enter the pipe network through a few of the inlets, the smoke mixes with the clean air provided to the pipe from the remainder of the inlets. As a result of this dilution, the smoke detectable from the smoke and air mixture may not exceed the threshold necessary to indicate the existence of a fire.

BRIEF DESCRIPTION

Disclosed is a system for smoke detection. The system includes a first device includes an optical signal source configured to transmit an optical signal through a medium, a second device configured to receive the optical signal through the medium, wherein the first device and the second device are communicatively coupled to a controller, wherein the controller is configured to operate the first device to transmit a first alphanumeric code to the second device by operating the first device to transmit a modulated optical signal to the second device, wherein the modulated optical signal represents the first alphanumeric code, analyze the modulated optical signal received at the second device to convert the modulated optical signal to a second alphanumeric code, and compare the first alphanumeric code to the second alphanumeric code to determine a presence of one or more conditions between the first device and second device.

In addition to one or more of the features described above, or as an alternative, further embodiments of the system may include that the one or more conditions are one or more of smoke and fire.

In addition to one or more of the features described above, or as an alternative, further embodiments of the system may include that the modulated optical signal includes a modulation of a frequency of the optical signal.

In addition to one or more of the features described above, or as an alternative, further embodiments of the system may include that the modulated optical signal includes a modulation of an amplitude of the optical signal.

In addition to one or more of the features described above, or as an alternative, further embodiments of the system may include that the optical signal source includes a light emitting diode (LED) or florescent bulb.

In addition to one or more of the features described above, or as an alternative, further embodiments of the system may include that the modulated optical signal includes an ON state for the optical signal and an OFF state for the optical signal.

In addition to one or more of the features described above, or as an alternative, further embodiments of the system may include that the alphanumeric code includes a binary code.

In addition to one or more of the features described above, or as an alternative, further embodiments of the system may include that the binary code includes a 1 representative of the ON state for the optical signal and a 0 representative of the OFF state for the optical signal.

In addition to one or more of the features described above, or as an alternative, further embodiments of the system may include that the optical signal is a first optical signal, that the second device is further configured to transmit a second optical signal through the medium and that the first device is further configured to receive the second optical signal through the medium.

In addition to one or more of the features described above, or as an alternative, further embodiments of the system may include that the optical signal includes at least one of visible light, infrared light and ultraviolet light.

Disclosed is method for smoke detection. The method includes operating a first device to transmit a first alphanumeric code to a second device by transmitting a modulated optical signal to the second device, wherein the modulated optical signal represents the first alphanumeric code, wherein the first device includes an optical signal source configured to transmit a modulated optical signal through a medium, and wherein the second device is configured to receive the modulated optical signal through the medium. Analyzing the modulated optical signal received at the second device to convert the modulated optical signal to a second alphanumeric code and comparing the first alphanumeric code to the second alphanumeric code to determine a presence of one or more conditions between the first device and second device.

In addition to one or more of the features described above, or as an alternative, further embodiments of the system may include that the one or more conditions are one or more of smoke and fire.

In addition to one or more of the features described above, or as an alternative, further embodiments of the system may include that the modulated optical signal includes a modulation of a frequency of the optical signal.

In addition to one or more of the features described above, or as an alternative, further embodiments of the system may include that the modulated optical signal includes a modulation of an amplitude of the optical signal.

In addition to one or more of the features described above, or as an alternative, further embodiments of the system may include that the optical signal source includes a light emitting diode (LED) or Fluorescent bulb.

In addition to one or more of the features described above, or as an alternative, further embodiments of the system may include that the modulated optical signal includes an ON state for the optical signal and an OFF state for the optical signal.

In addition to one or more of the features described above, or as an alternative, further embodiments of the system may include that the alphanumeric code includes a binary code.

In addition to one or more of the features described above, or as an alternative, further embodiments of the system may include that the binary code includes a 1 representative of the ON state for the optical signal and a 0 representative of the OFF state for the optical signal.

In addition to one or more of the features described above, or as an alternative, further embodiments of the system may include that the optical signal is a first optical signal, that the second device is further configured to transmit a second optical signal through the medium and that the first device is further configured to receive the second optical signal through the medium.

In addition to one or more of the features described above, or as an alternative, further embodiments of the system may include that the optical signal includes at least one of visible light, infrared light and ultraviolet light.

BRIEF DESCRIPTION OF THE DRAWINGS

The following descriptions should not be considered limiting in any way. With reference to the accompanying drawings, like elements are numbered alike.

Figure 1A:
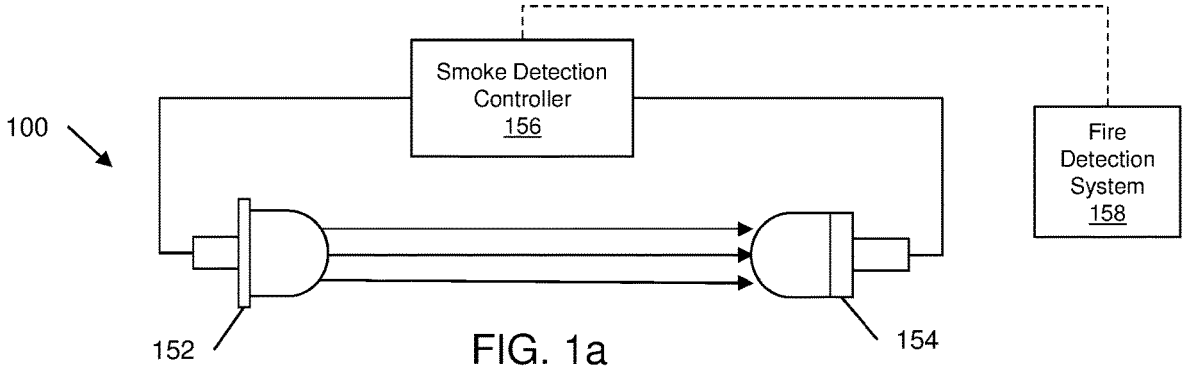
FIG. 1*a* depicts a diagram of a system for smoke detection according to embodiments.

The diagrams depicted herein are illustrative. There can be many variations to the diagram or the operations described therein without departing from the spirit of the disclosure. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

Turning now to an overview of technologies that are more specifically relevant to aspects of the disclosure, a fire detection system can utilize photoelectric technology between light emitting and light sensitive sensors or devices for determining the presence of particulates in the space between the sensors. The particulates can include, for example, smoke from a fire. Most photoelectric technology used for the detection of ambient hazards utilizes light scattering to determine the presence of particles in the ambient atmosphere to indicate the existence of a condition or event. In this specification, the term "scattered light" may include any change to the amplitude/intensity or direction of the incident light, including reflection, refraction, diffraction, absorption, and scattering in any/all directions. In this example, light is emitted into the designated area; when the light encounters an object (a person, smoke particle, or gas molecule for example), the light can be scattered and/or absorbed due to a difference in the refractive index of the object compared to the surrounding medium (air). Depending on the object, the light can be scattered in all different directions. Observing any changes in the incident light, by detecting light scattered by an object for example, can provide information about the designated area including determining the presence of a condition or event. In this case, the condition or event is smoke from a fire. Some drawbacks to conventional photoelectric technology include slow detection time and the potential for false alarms due to accumulation of dust or particles on reflection plates used in the photoelectric smoke detection system.

Turning now to an overview of the aspects of the disclosure, one or more embodiments address the above-described shortcomings of the prior art by providing a system for smoke detection utilizing light fidelity technology.

Turning now to a more detailed description of aspects of the present, FIG. 1*a* depicts a diagram of a system for smoke detection utilizing light fidelity signals according to one or more embodiments. Light fidelity, or Li-Fi, refers to a technology for wireless communication between devices using light to transmit data. Li-Fi is a visible light communication (VLC) and uses light emitting diodes (LED) or fluorescent light for its propagation. As explained in the exemplary system herein Li-Fi systems may be used for hazard detection instead of or in addition to being used for communications purposes.

Figure 1B:
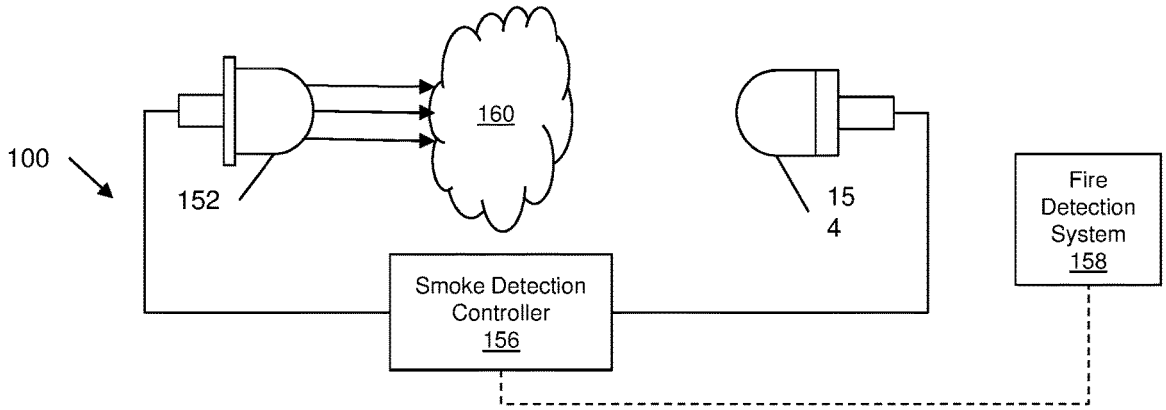
FIG. 1*b* depicts a diagram of a system for smoke detection with the presence of smoke according to embodiments.

In exemplary embodiments shown in FIGS. 1*a* and 1*b*, the system 100 includes an emitter 152 as a source of a Li-Fi signal and a receiver 154. The emitter 152 may be any of an LED emitter that can include a bulb, radio frequency (RF) power amplifier, a circuit board, and enclosure of the emitter 152. In one or more embodiments, the emitter 152 may include a fluorescent bulb. The receiver 154 may be a silicon photo decoder, for example. The system 100 includes a smoke detection controller 156 that can be communicatively coupled to the emitter 152 and receiver 154. The system 100 also includes a fire detection system 158. The smoke detection controller 156 may be implemented on a computing system including a processor and a memory. The fire detection system 158 may be a control system for a site or facility that can generate an alarm in the case of a fire and/or initiate a fire suppression measure, such as a sprinkler system.

In one or more embodiments, the emitter 152 may transmit a Li-Fi signal to the emitter 154. The LiFi signal may be modulated electromagnet radiation in the form of visible light, ultra violet light, or infrared light. The modulation of this "light" allows for the transmission of data from the emitter 152 to the receiver 154. For example, a high signal or ON signal can represent an alphanumeric character such as the binary 1 and a low signal or OFF signal can represent the binary 0. This combination of 1s and 0s can be utilized to transmit data from the emitter 152 to the receiver 154. The modulated electromagnet radiation (or signal) is transmitted through a medium, such as air. The receipt of this data from the emitter 152 at the receiver 154 can confirm that there are no particles or particulates blocking the signal. When the data is incomplete or not being received by the receiver 154, then the smoke detection controller 156 can determine that there is smoke blocking the LiFi signal and thus a fire is present.

FIG. 1*b* depicts a diagram of the smoke detection system 100 with the presence of smoke 160 according to one or more embodiments. The system 100 includes the same components from FIG. 1*a*. In the illustrated example, smoke 160 is shown blocking the LiFi signal and thus the data being transmitted from the emitter 152 is not being received by the receiver 154. When this occurs the smoke detection controller 156 can determine the presence of the smoke 160 and signal the fire detection system 158 to invoke an action such as sound an alarm or initiate fire suppression in the area proximate to the emitter 152 and receiver 154.

In one or more embodiments, both the emitter 152 and receiver 154 can have emitter and receiver capabilities which allows for rectification to verify the presence of smoke 160 or other conditions. For example, the emitter 152 can transmit an LiFi (optical) signal and receive a second LiFi (optical) signal from either another emitter or from the receiver 154 having its own emitter capabilities. The second optical signal can have similar properties as the first LiFi (optical) signal. Or, in some embodiments, the second LiFi (optical) signal can transmit different data than the first LiFi (optical) signal. For example, a different alphanumeric or binary sequence can be transmitted by the receiver 154 in the second LiFi (optical) signal and decoded at the emitter 152. The emitter 152 can include a photo decoder and the receiver 154 can include an LED bulb or other type of electromagnetic radiation emitter. In one or more embodiments, the "light" utilized between the emitter 152 and receiver 154 can be dim so as to not be visible to the human eye. However, the modulation of this dim light can still transmit data from the emitter 152 to the receiver 154. The modulation can be a flicker of the light such as a transition from an ON state to an OFF state representing binary data (1s and 0s). In one or more embodiments, the modulation of the "light" can be time, amplitude, or frequency based modulations of the light signal.

Figure 2:
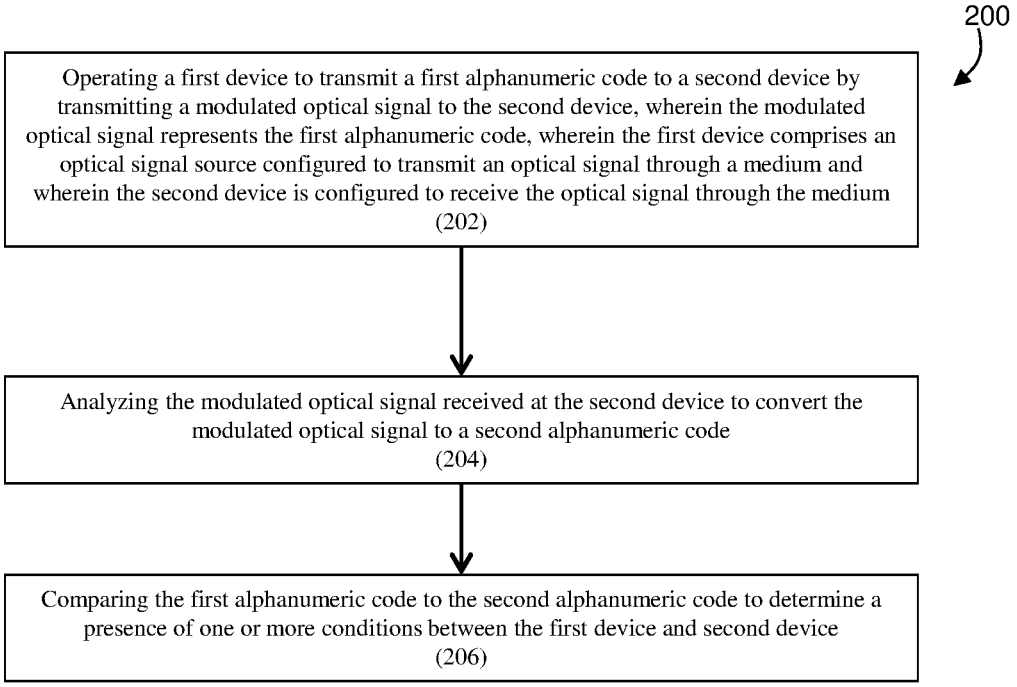
FIG. 2 depicts a diagram of a method for smoke detection with data transmission according to embodiments.

FIG. 2 depicts a flow diagram of a method for smoke detection according to one or more embodiments. The method 200 includes operating a first device, such as the emitter 152, to transmit a first alphanumeric code to a second device, such as the receiver 154, by transmitting a modulated optical signal to the second device, wherein the modulated optical signal represents the first alphanumeric code, wherein the first device comprises an optical signal source configured to transmit an optical signal through a medium, such as air, and wherein the second device is configured to receive the optical signal through the medium, as shown in block 202. The first alphanumeric code can be a binary number, a hexadecimal number, a string of characters, or a combination any type of numbers, letters, characters, and the like. At block 204, the method 200 includes analyzing the modulated optical signal received at the second device (receiver 154) to convert the modulated optical signal to a second alphanumeric code. The second alphanumeric code can be a binary number, a hexadecimal number, a string of characters, or a combination any type of numbers, letters, characters, and the like. And at block 206, the method 200 includes comparing the first alphanumeric code to the second alphanumeric code to determine a presence of one or more conditions between the first device and second device. The one or more conditions may be the presence of smoke or other particulates in the air space between the emitter 152 and the receiver 154.

Additional processes may also be included. It should be understood that the processes depicted in FIG. 2 represent illustrations and that other processes may be added or existing processes may be removed, modified, or rearranged without departing from the scope and spirit of the present disclosure.

Figure 3:
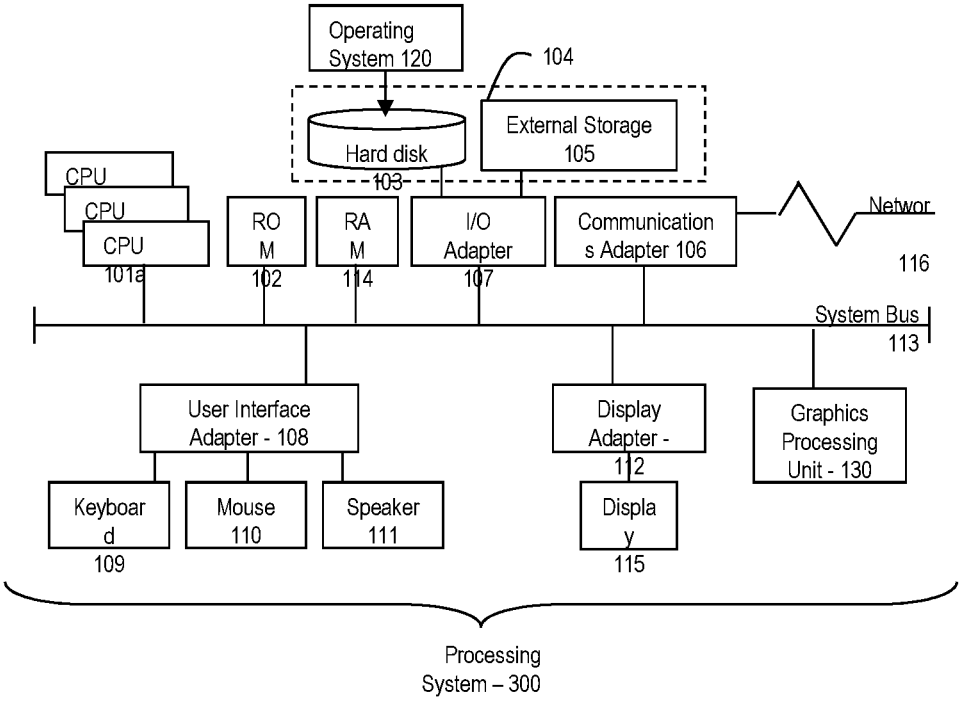
FIG. 3 depicts a block diagram of a computer system for use in implementing one or more embodiments.

FIG. 3 depicts an exemplary processing system 300 for implementing the teachings herein. The exemplary processing system 300 includes components that can be fabricated on a printed circuit board (PCB). The PCB can be utilized for implementing the various components described in the system 100 of FIG. 1. For example, the emitter 152 and the receiver 154 include circuitry utilized to implement logic operations. This circuitry can be implemented utilizing means described in FIG. 3 including but not limited to central processing units, FPGAs, ASICS, and the like. In one or more embodiments, the emitter 102, the receiver 104, the smoke detection controller 106, and/or the fire detection system 108 can be implemented on the processing system 300 utilizing any of the components described herein. The processing system 300 described herein is merely exemplary and not intended to limit the application, uses, and/or technical scope of the present disclosure, which can be embodied in various forms known in the art. This exemplary system 100 may include one or more central processing units (processors) 101*a*, 101*b*, 101*c*, etc. (collectively or generically referred to as processor(s) 101). In one embodiment, each processor 101 may include a reduced instruction set computer (RISC) microprocessor, such as, for example, one or more ARM architecture processors. Processors 101 are coupled to system memory 114 and various other components via a system bus 113. Read only memory (ROM)

102 is coupled to the system bus 113 and may include a basic input/output system (BIOS), which controls certain basic functions of system 300.

Additionally, a network can be in wired or wireless electronic communication with one or all of the elements of the system 100. For example, the emitter 152 and receiver 154 can communicate with the smoke detector controller 156 which can be located remote from the emitter 152 and receiver 154. The smoke detection controller 156 can be housed in a fire system control panel for a building site. The smoke detection controller 156 can utilize any of the computing components described in the system 300 of FIG. 3 including but not limited to input/output means, such as a keyboard, keypad, mouse, touchscreen, or other similar input/output means. In addition, cloud computing can supplement, support or replace some or all of the functionality of the elements of the system 100. The emitter 152 and the receiver 154 may include transceivers configured to transmit data to a wireless network gateway and forwarded to a cloud server for processing of information. The data collected can be stored in the cloud server. Additionally, some or all of the functionality of the elements of system 100 can be implemented as a cloud computing node.

FIG. 3 further depicts an input/output (I/O) adapter 107 and a network adapter 106 coupled to the system bus 113. As described above, the elements of the system 100 can receive input from users for setup and programing purposes. For example, the smoke detector controller 156 can receive data from a user, utilizing a keypad or keyboard, for set up, testing, and/or reprogramming the emitter 152 and receiver 154 in the system 100. In an exemplary embodiment I/O adapter 107 may be a small computer system interface (SCSI) adapter that communicates with a hard disk 103 and/or external storage drive 105, such as a USB drive or an optical drive, or any other similar component. I/O adapter 107, hard disk 103, and external storage device 105 are collectively referred to herein as mass storage 104. Operating system 120 for execution on the processing system 100 may be stored in mass storage 104. A network adapter 106 interconnects bus 113 with an outside network 116 enabling data processing system 100 to communicate with other such systems. A screen (e.g., a display monitor) 115 is connected to system bus 113 by display adaptor 112, which may include a graphics adapter to improve the performance of graphics intensive applications and a video controller. In one embodiment, adapters 107, 106, and 112 may be connected to one or more I/O busses that are connected to system bus 113 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 113 via user interface adapter 108 and display adapter 112. A keyboard (keypad) 109, mouse 110 (e.g., input means), and speaker 111 all interconnected to bus 113 via user interface adapter 108, which may include, for example, a Super I/O chip integrating multiple device adapters into a single integrated circuit. The I/O devices can be utilized as input in to the system 100 (from FIG. 1). The display screen 115 can be any type of display such as a monitor associated with a computer or can be a display screen for a phone or tablet.

In exemplary embodiments, the processing system 100 includes a graphics processing unit 130. Graphics processing unit 130 is a specialized electronic circuit designed to manipulate and alter memory to accelerate the creation of images in a frame buffer intended for output to a display. In general, graphics processing unit 130 is very efficient at manipulating computer graphics and image processing, and has a highly parallel structure that makes it more effective than general-purpose CPUs for algorithms where processing of large blocks of data is done in parallel. GPUs 130 belong to a class of hardware accelerators that are configured to handle operations that are highly parallel in structure. Some or all the functionality of the system 100 can be offloaded on or more hardware accelerators such as, for example, the GPU 130 described herein.

A detailed description of one or more embodiments of the disclosed apparatus are presented herein by way of exemplification and not limitation with reference to the Figures.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system for smoke detection, the system comprising:
a first device comprising an optical signal source configured to transmit an optical signal through air;
a second device configured to receive the optical signal through the air, wherein the first device and the second device are communicatively coupled to a controller, wherein the controller is configured to:
operate the first device to transmit a first alphanumeric code to the second device by operating the first device to transmit a modulated optical signal to the second device, wherein the modulated optical signal represents the first alphanumeric code;
analyze the modulated optical signal received at the second device to convert the modulated optical signal to a second alphanumeric code; and
compare the first alphanumeric code to the second alphanumeric code to determine a presence of one or more conditions between the first device and second device.

2. The system of claim 1, wherein the one or more conditions comprises a presence of smoke.

3. The system of claim 1, wherein the modulated optical signal comprises a modulation of a frequency of the optical signal.

4. The system of claim 1, wherein the modulated optical signal comprises a modulation of an amplitude of the optical signal.

5. The system of claim 1, wherein the optical signal source comprises a light emitting diode (LED).

6. The system of claim 1, wherein the optical source comprises a florescent bulb.

7. The system of claim 1, wherein the modulated optical signal comprises an ON state for the optical signal and an OFF state for the optical signal.

8. The system of claim 1, wherein the first alphanumeric code comprises a binary code and the second alphanumeric code comprises a binary code.

9. The system of claim 8, wherein the binary code comprises a 1 representative of the ON state for the optical signal and a 0 representative of the OFF state for the optical signal.

10. The system of claim 1, wherein the optical signal is a first optical signal; and wherein the second device is further configured to transmit a second optical signal through the air; and wherein the first device is further configured to receive the second optical signal through the air.

11. The system of claim 1, wherein the optical signal comprises at least one of visible light, infrared light and ultraviolet light.

12. A method for smoke detection, the method comprising:

operating a first device to transmit a first alphanumeric code to a second device by transmitting a modulated optical signal to the second device, wherein the modulated optical signal represents the first alphanumeric code;

wherein the first device comprises an optical signal source configured to transmit a modulated optical signal through air; and wherein the second device is configured to receive the modulated optical signal through the air;

analyzing the modulated optical signal received at the second device to convert the modulated optical signal to a second alphanumeric code; and comparing the first alphanumeric code to the second alphanumeric code to determine a presence of one or more conditions between the first device and second device.

13. The method of claim 12, wherein the one or more conditions are one or more of smoke.

14. The method of claim 12, wherein the modulated optical signal comprises a modulation of a frequency of the optical signal.

15. The method of claim 12, wherein the modulated optical signal comprises a modulation of an amplitude of the optical signal.

16. The method of claim 12, wherein the optical signal source comprises a light emitting diode (LED).

17. The method of claim 12, wherein the optical signal source comprises a fluorescent bulb.

18. The method of claim 12, wherein the modulated optical signal comprises an ON state for the optical signal and an OFF state for the optical signal.

19. The method of claim 12, wherein the first alphanumeric code comprises a binary code and the second alphanumeric code comprises a binary code.

* * * * *